United States Patent [19]

Cristaldi

[11] 4,199,928

[45] Apr. 29, 1980

[54] TOW SPLICING APPARATUS

[75] Inventor: Lucian M. Cristaldi, Haddonfield, N.J.

[73] Assignee: E. I. Du Pont de Nemours and Company, Wilmington, Del.

[21] Appl. No.: 966,255

[22] Filed: Dec. 4, 1978

[51] Int. Cl.[2] ..... B65H 69/06; D02J 1/08

[52] U.S. Cl. ..... 57/22

[58] Field of Search ..... 57/22, 23; 28/209–211

[56] References Cited

U.S. PATENT DOCUMENTS

| | | | |
|---|---|---|---|
| 3,339,362 | 9/1967 | Dodson, Jr. et al. | 57/22 |
| 3,458,905 | 8/1969 | Dodson, Jr. et al. | 57/22 X |
| 3,822,538 | 7/1974 | Cardell | 57/22 |
| 3,871,164 | 3/1975 | Nunn | 57/22 |
| 4,002,013 | 1/1977 | Johnson et al. | 57/22 |

FOREIGN PATENT DOCUMENTS 1582148 9/1969 France .

*Primary Examiner*—John Petrakes

[57] ABSTRACT

A pneumatic tow splicer for splicing a plurality of pairs of yarn segments into joints includes a device for dividing the tow into a plurality of substantially equal-sized segments prior to splicing. The dividing device includes a plurality of vertical flexible guides pressed together. A bundle of tow is pressed between the guides and the pressure on the guides is released and they spring apart separating the tow into substantially equal-sized segments.

2 Claims, 11 Drawing Figures

TOW SPLICING APPARATUS

BACKGROUND

This invention relates to splicing ends of yarn by air entanglement and, more particularly it relates to an apparatus for dividing a tow into a plurality of substantially equal-sized segments prior to splicing and distributing the segments across a splicing device so that the spliced region will extend diagonally across the width of the spliced tow.

While joining ends of yarn from tow bundles by previous air entanglement methods has been somewhat satisfactory, there has heretofore been no device which would consistently provide a means for dividing the tow into substantially equal-sized segments before splicing.

SUMMARY OF THE INVENTION

Such a device is now provided in a tow splicing apparatus that includes a yarn clamping assembly for securing a plurality of pairs of abutting parallel yarn segments in spaced configuration, and an assembly for entangling the filaments of one yarn segment of each pair with the filaments of the other yarn segment of that pair to form a joint. The device for dividing a tow into a plurality of substantially equal-sized segments comprises: a member attached to said yarn clamping assembly having a plurality of slots therein for reception of individual segments of yarn; a plurality of flexible guides, each guide being attached at one end to a location between said slots and extending in a vertical direction, said guides being pointed at their other ends; means for releasably pressing together the pointed ends of said guides; a retractable U-shaped anvil for supporting said tow to flatten it into a uniform warp positioned astride said pointed ends, said anvil being movable vertically from a position above said pointed ends to a position below said pointed ends as the tow is flattened on said anvil; and means for retracting said anvil from the vicinity of said pointed ends and releasing the pressure on said flexible guides as said tow is forced between said pointed ends in being flattened on said anvil into a uniform warp.

DETAILED DESCRIPTION

Figure 1:
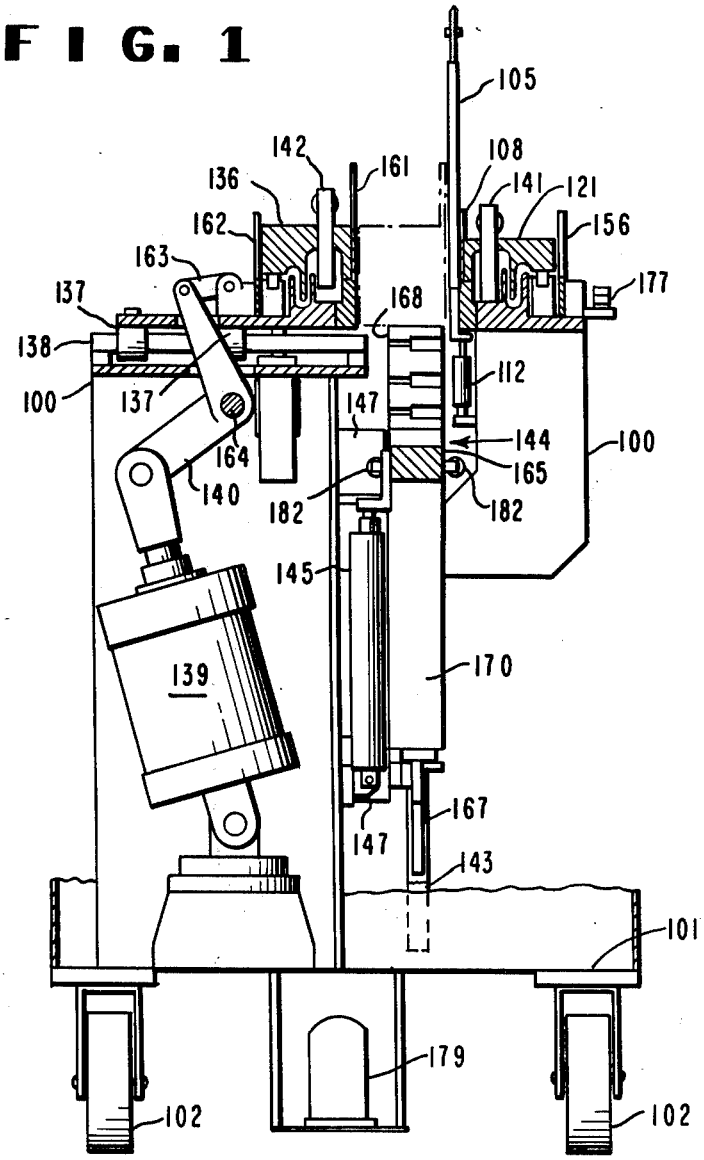
FIG. 1 is a front view partly in cross section of the apparatus of the invention.
Figure 2:
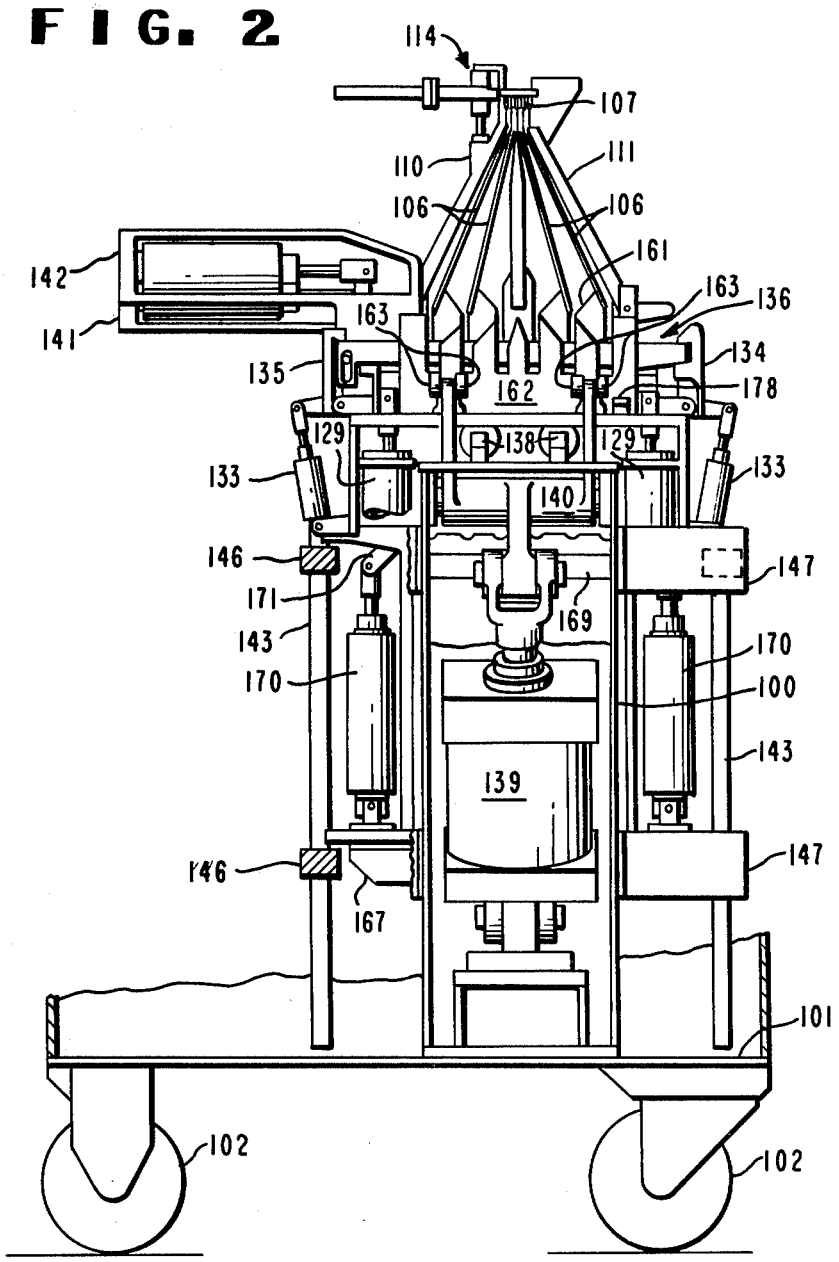
FIG. 2 is a side view of the apparatus of FIG. 1.
Figure 3:
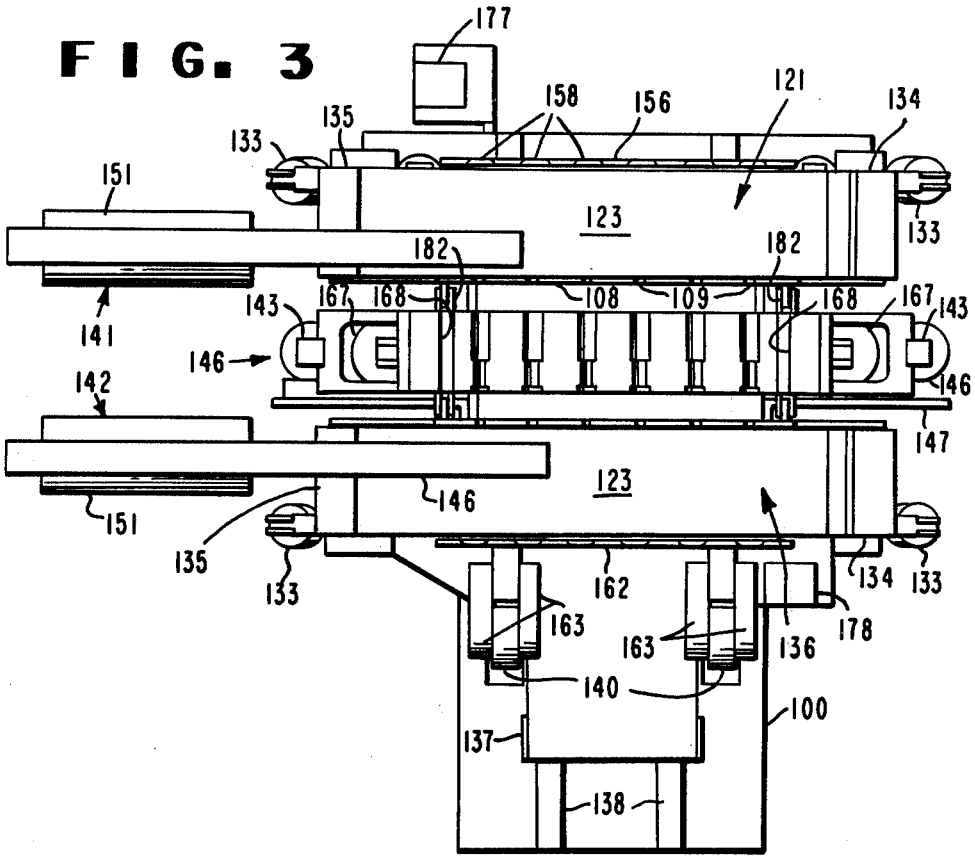
FIG. 3 is a plan view of the apparatus of FIG. 1 shown with the tow dividing assembly removed for clarity.

Referring to FIGS. 1, 2 and 3, the embodiment chosen for purposes of illustration includes a frame 100 supported on a base 101 having castors 102 for convenient movement of the apparatus from place to place within the operating area. The tow dividing device generally designated 105 is supported on stationary yarn clamp 121 which is, in turn, supported on frame 100. Yarn clamp 136 is supported by means of bearings 137 on rails 138 which are mounted on frame 100. Associated with yarn clamp 136 is cylinder 139 affixed to base 101 and linkage 140 required to move clamp 136 toward and away from clamp 121. Within each of clamps 121 and 136 is a cutter, 141 and 142, respectively. Also supported on frame 100 by means of rods 143 confined in bearings 146 affixed to brackets 147 is splicing assembly 144 having cylinder 145 attached to frame 100.

Figure 5:
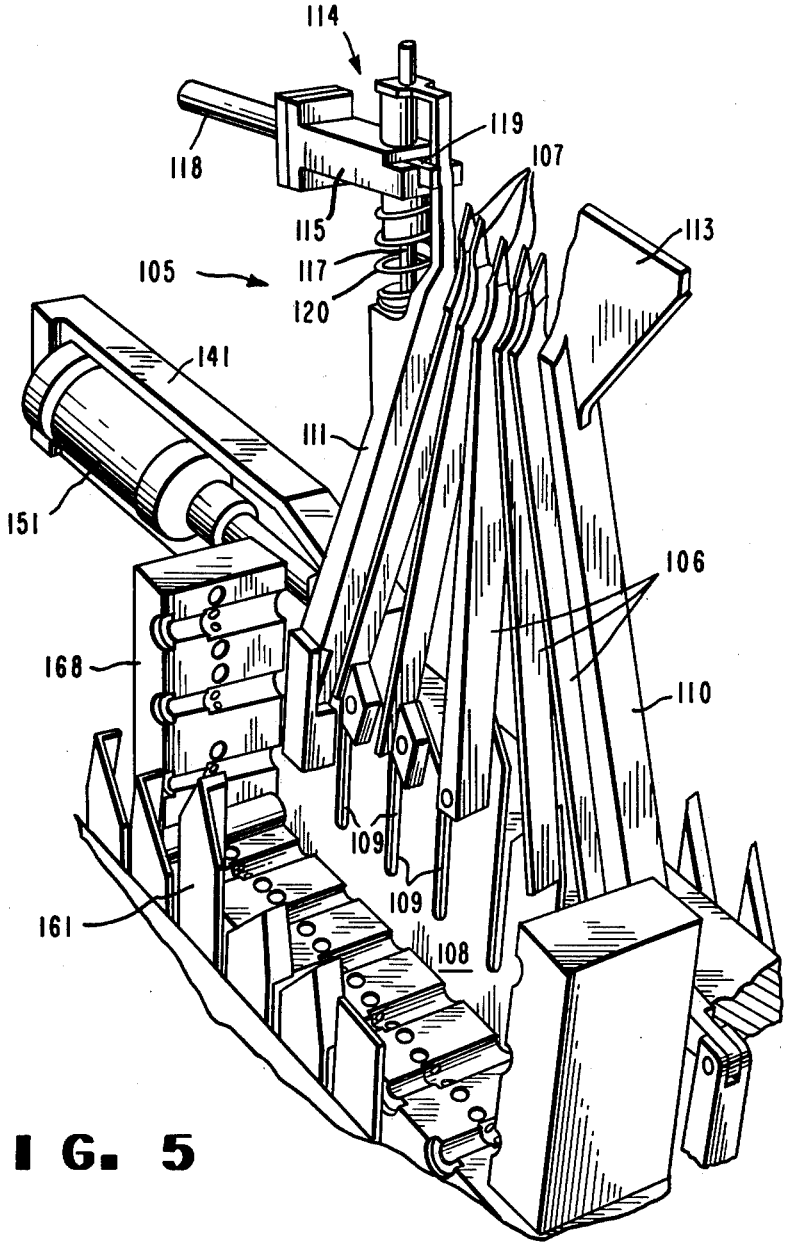
FIG. 5 is an enlarged perspective of the tow dividing assembly.
Figure 6:
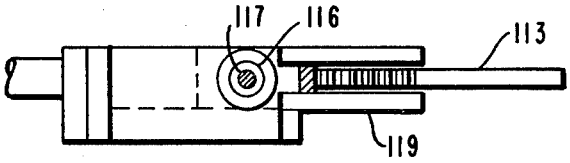
FIG. 6 is a partly cross-sectional view of the yarn distributing assembly.
Figure 7:
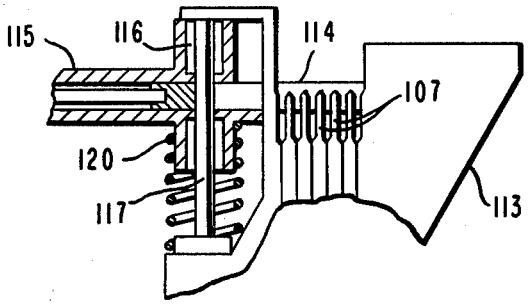
FIG. 7 is a plan view of the yarn distributing assembly.

Referring now to FIG. 5, tow dividing device 105 includes a plurality of generally vertical flexible guides 106 each carrying at its upper end a pointed piercing element 107 and attached at its lower end to yarn positioner 108 secured to yarn clamp 121 described below. Yarn positioner 108 has a plurality of vertical slots 109 for the reception of individual sections of yarn and guides 106 are positioned between said slots 109. Guides 106 are shaped so that they converge above yarn positioner 108 and form there a row of slightly spaced pointed piercing elements 107. L-shaped levers 110, 111 are pivotably attached to yarn positioner 108 and extend upward past piercing elements 107. The lower ends of levers 110, 111 are attached to the rods of pneumatic cylinders 112 secured to frame 100 (FIG. 1). These elements are so arranged that extension of the rods of cylinders 112 causes levers 110, 111 to press together piercing elements 107 while retraction moves levers 110, 111 away from elements 107, allowing guides 106 to spring apart. Cylinders 112 are spring biased so that with no air pressure supplied the rods are extended. The upper end of lever 110 is formed into a flat plate 113 having a horizontal upper edge. Lever 111 carries yarn distributing assembly 114, best understood by reference to FIGS. 6 and 7, which comprises a housing 115 having bearings 116 which slide on vertical rod 117 mounted on lever 111. Carried on housing 115 is pneumatic cylinder 118 having a rod extending through housing 115 to connect with a U-shaped two pronged anvil 119 lying in a slot in housing 115 and straddling rod 117. Spring 120 urges housing 115 upward. In the uppermost position of housing 115 anvil 119 is higher than piercing elements 107 and envelops them (FIGS. 6 and 7). Retraction of the rod of cylinder 118 pulls anvil 119 into housing 115 away from yarn piercing elements 107.

Figure 4:
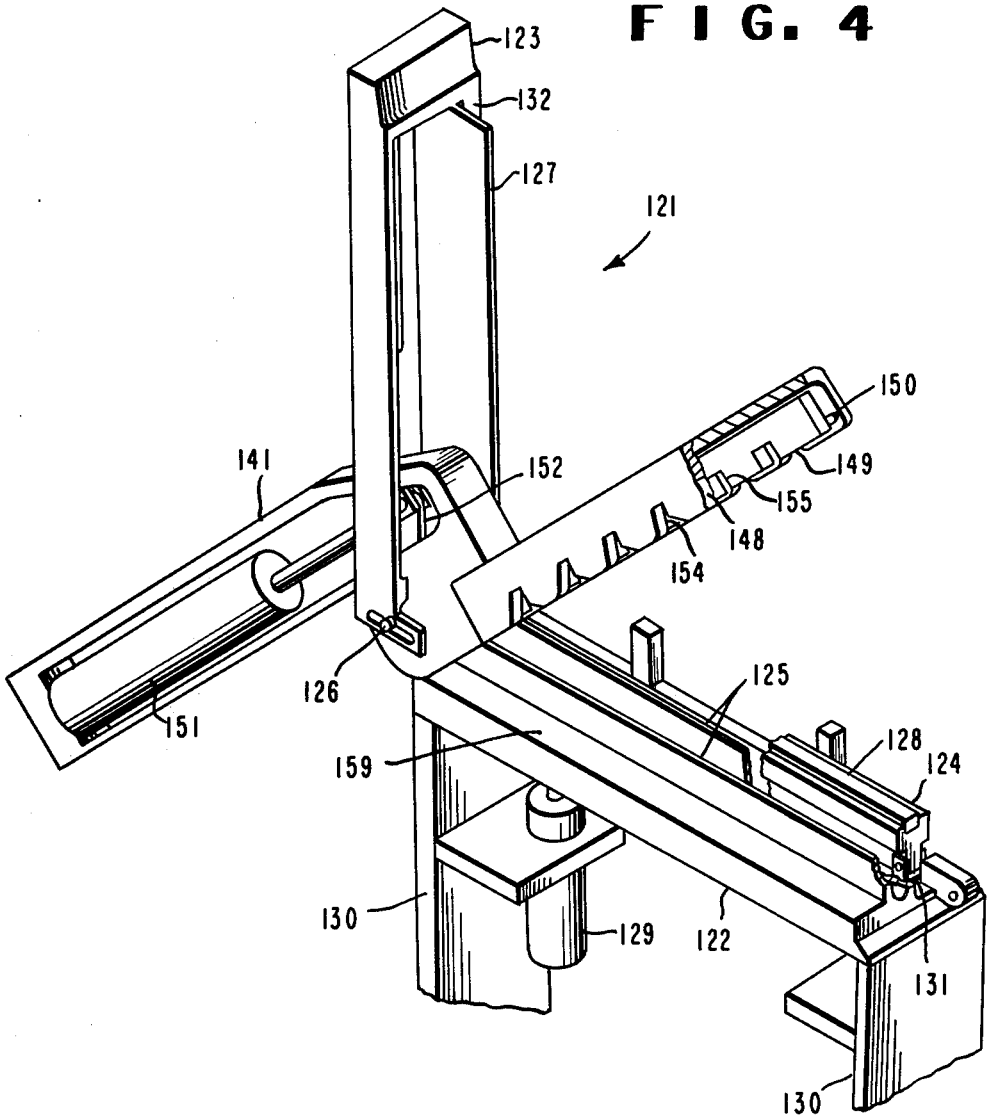
FIG. 4 is a perspective of the stationary yarn clamp and cutter assembly.

Referring now to FIG. 4, yarn clamp 121 is affixed to frame 100 and yarn positioner 108. Yarn clamp 136 is substantially a mirror image of yarn clamp 121, similar parts of the two clamps having the same number designation in the drawings. Clamp 121 comprises a base 122, lid 123, and clamping bar 124. Base 122 includes two upstanding blade-like projections 125 extending the length thereof. Lid 123 is hingedly connected to base 122 by means of pin 126 and includes a lengthwise projection 127 which, when lid 123 is closed, coacts with projections 125 on base 122 to form the labyrinth path shown in FIG. 8. Clamping bar 124 lies between lid 123 and base 122 outboard of blades 125 and is attached to the rods of pneumatic cylinders 129 which are secured to brackets 130 on base 122 with rods extending through holes 131 in base 122. Cylinders 129 are spring biased so that the clamping bar 124 is normally down but may be raised by pressurized air being supplied to cylinders 129. Clamping bar 124 has an insert 128 of elastomeric material on its upper surface. Lid 123 has a flat area 132 which, when lid 123 is in the closed position is disposed directly above clamping bar 124. Also secured to brackets 130 are cylinders 133 which operate clamps 134, 135 pivotably attached to either end of base 122 which serve to secure lid 123 in the closed position (FIG. 3). Cylinders 133 are spring biased so that clamps 134 and 135 are normally in the clamping position but can be unclamped by pressurized air being supplied to cylinders 133. Still with respect to FIG. 4, cutter 141 comprises housing 146, blades 148 and 149, and actuating cylinder 151. The blade portion of cutter 141 is enclosed in clamp 121 with housing 146 projecting through lid 123 so that cylinder 151 extends to the rear of clamp 121. Stationary blade 148 is a flat rectangular, hardened metal member secured to housing 146 so as to form therewith an inverted U-shaped section. Movable blade 149 is confined within this U-shaped section and is forced against stationary blade 148 by means of small buttons 150 of slightly deformable, low friction material such as Teflon ® secured to blade 149 and riding on housing 146. Movable blade 149 is connected to pneumatic cylinder 151 through pivoting link 152 so that extension of the rod of cylinder 151 draws blade 149 rearward and retraction moves blade 149 forward. Vertical slots are formed in housing 146 and in blades 148 and 149 which are colinear when movable blade 149 is in its forward position. Cooperating cutting edges are formed on the forward edges 154 of the slots of blade 148 and on the rear edges 155 of the slots of blade 149. Outside yarn positioner 156 (FIG. 1) is similar to yarn positioner 108 being a vertical plate with vertical slots, the slots on yarn positioner 108, cutter 141 and yarn positioner 156 being colinear. Cutter 141 is pivotably attached to yarn clamp 121 by means of pin 126 and is positioned such that when cutter 141 is down the blade portion 147 rests on flat area 159 of base 122.

Figure 9:
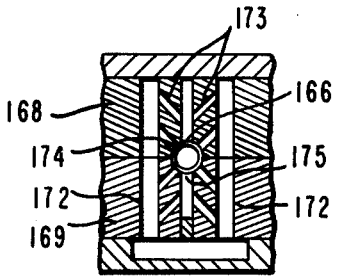
FIGS. 9 and 10 are cross-sectional representations of one of the splicing cavities.
Figure 10:
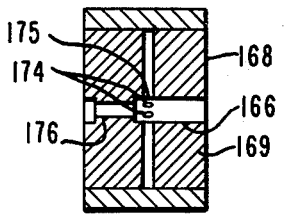
Figure 8:
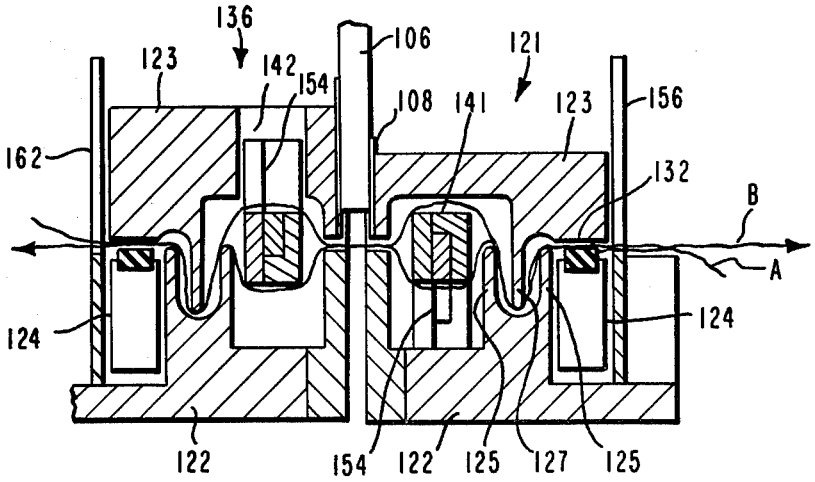
FIG. 8 is an enlarged cross-sectional view of the yarn clamps with yarn in position.

Referring now to FIGS. 1 and 8, yarn clamp 136 is substantially a mirror image of yarn clamp 121 including yarn positioners 161, 162. Cutter 142 is similar in construction to cutter 141 but with slots formed in the upper rather than lower edge of blade portion 147. Cutter 142 is positioned within clamp 136 such that when cutter 142 is lowered toward base 122 there is a gap between the two elements. Clamp 136 is supported by bearings 137 riding on rails 138 on frame 100 and is attached by links 163 to lever 140 pivotably supported by shaft 164 which is journaled in frame 100. The lower end of lever 140 is attached to the rod of pneumatic cylinder 139 supported on base 101. These elements are so arranged that extension of the rod of cylinder 139 moves clamp 136 into a position adjacent guides 106 (shown in broken lines in FIG. 1) and retraction moves clamp 136 away from guides 106 into the position shown in FIG. 1. Splicing assembly 144, best seen in FIGS. 1 and 3, comprises a jet block 165 having a multiplicity of splicing cavities and supported by means of rods 143 in bearings 146 which are affixed to brackets 147 on frame 100. Also affixed to rods 143 is a lower brace member 167. A pneumatic cylinder 145 is mounted on frame 100 with its rod connected to jet block 165 such that extension of the cylinder 145 raises jet block 165, rods 143 sliding in bearings 146. Jet block 165 comprises jet body 169 and two lid sections 168 hinged at the ends of jet body 169. Cylinders 170 mounted on brace member 167 act through levers 171 to open and close lid sections 168. On the right side of jet block 165, as viewed in FIG. 1, is a pair of rollers 182 positioned so as to roll on the surface of yarn positioner 108. An identical pair of rollers is attached to the left side of jet block. Each jet cavity is the type shown in FIGS. 9 and 10 with entanglement chamber 166 formed partially in the body 169 and partially in lid 168. Compressed air is supplied from a source through cavities 172 and passages 173 to ports 174 and 175 in entanglement chamber 166. Ports 174 are of equal size and spaced 90° from one another, all on a single circumferential line, and ports 175 are larger than ports 174 and spaced 180° from one another, each being 45° from the nearest ports 174. Chamber 166 is not of uniform cross section but rather has a reduced cylindrical portion 176 in the middle. Yarn clips 177, 178 are located adjacent yarn clamps 121 and 136, clip 177 being near the hinge end of clamp 121 and clip 178 being near the opposite end of clamp 136. Each yarn clip is a device which will securely hold yarn pulled through the open slot.

Figure 11:
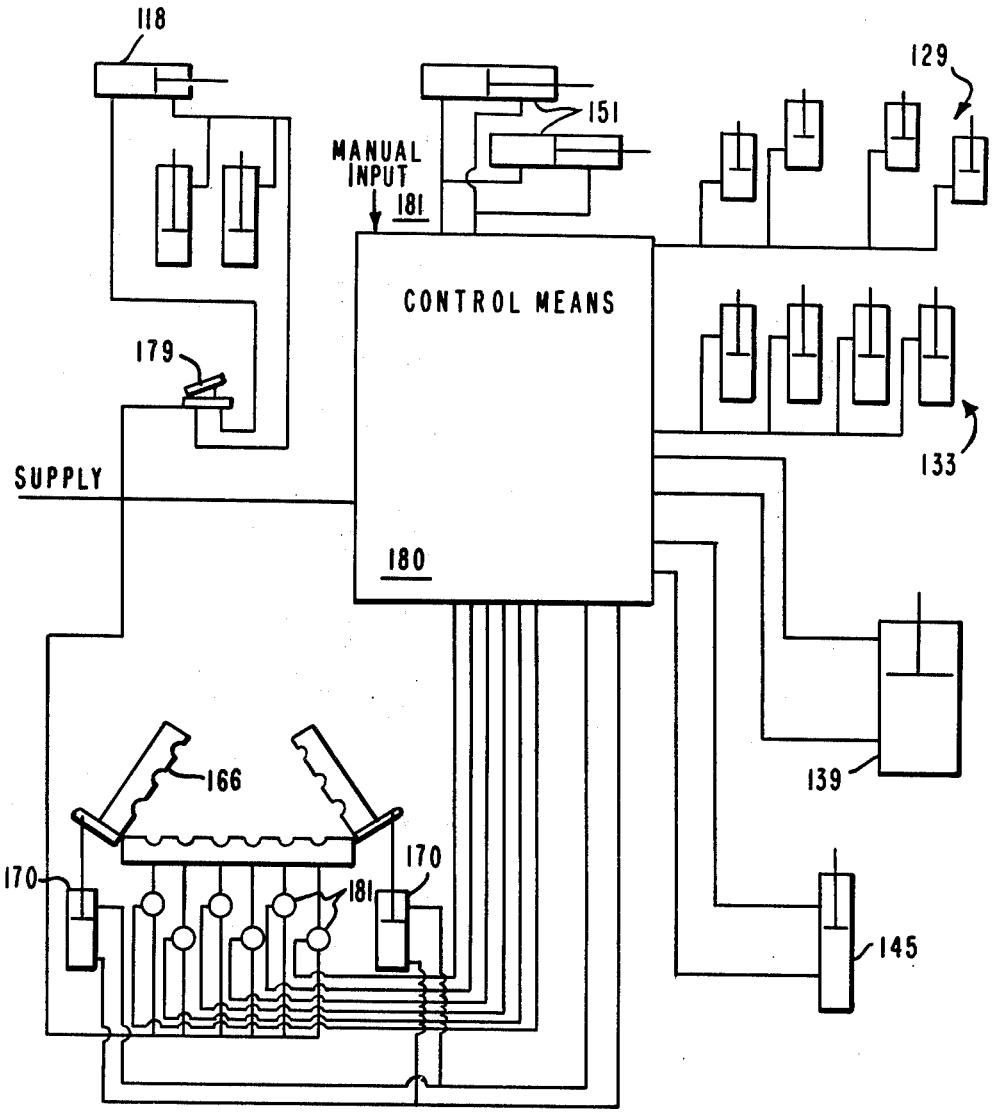
FIG. 11 is a generalized schematic representation of the control system of the apparatus.

Control of the system can be accomplished using any of a number of conventional control schemes. A generalized control diagram is shown in FIG. 11, in which the box designated 180 represents hardware, including pressure regulators and valves, for introducing pressurized air to the individual cylinders as well as control means, which can be pneumatic or electronic, for timing and sequencing the various operations. Pressurized air is supplied from an external source to this control means as well as to foot pedal 179 and through valves 181 to each individual entanglement chamber 166. Valves 181 are individually controlled by the general control means included in box 180. Foot pedal 179 and cylinders 112 and 118 are arranged so that when foot pedal 179 is depressed, pressurized air is supplied to retract cylinders 112 and 118 and when foot pedal 179 is released, pressurized air is supplied to extend cylinder 118 while cylinders 112 extend under force of their internal biasing springs. A pushbutton 181 or other manual input means is provided to permit operator initiation of the automatic portion of the machine cycle at the appropriate time as described below. One feature of the control means is provision of two different pressures of air which can be supplied to the return port of cylinder 139, that is, the port through which air is introduced to move yarn clamp 136 toward yarn clamp 121.

Prior to beginning a splicing sequence, the following condition exists:

1. Cylinders 112 are extended so that yarn guides 106 are pressed together by levers 110, 111.
2. Cylinder 118 is extended so that anvil 119 envelops yarn piercing elements 107.
3. Lids 123 of yarn clamps 121 and 136 and cutters 141 and 142 are raised; cylinders 129 are retracted so that clamping bar 124 is down; cylinders 151 are extended so that the slots in the cutter blades are aligned.
4. Cylinder 139 is extended so that yarn clamp 136 is adjacent guides 106.
5. Cylinder 145 is retracted so that splicing assembly 144 is in its lower position; cylinders 170 are retracted so that lid sections 168 are open.

To begin the splicing operation, an operator grasps one of the tows to be joined near its end. This tow is to be secured in the apparatus with its terminal end extending to the right of the apparatus as viewed in FIG. 1. The operator lays this tow over the upper edge of plate 113, drawing it back and forth several times to reduce it to a flat, fairly uniform warp. This warp is then laid over anvil 119 where it is further flattened by the same motion. Grasping the tow on either side of guides 106, the operator pulls the tow downward compressing spring 120 and forcing the tow between yarn piercing elements 107. Foot pedal 179 is now depressed, causing cylinders 112 and 115 to retract which, in turn, retracts anvil 119 from elements 107 and allows guides 106 to spring apart. The operator, still grasping the tow pulls the tow down into the slots 109 in yarn positioners 108 and 161 and positions it in yarn positioners 156, 162. Foot pedal 179 is released, returning anvil 119 and levers 110 and 111 to their initial position. The operator rotates the tow counterclockwise as viewed in FIG. 3 and slides the tow into clips 177 and 178 thereby positioning the strands of yarn across the splicing zone (the area between yarn positioners 108 and 161) such that the splices to be made will be distributed along that length of the tow held between clips 177 and 178. Cutters 141 and 142 are then lowered into yarn clamps 121 and 136. At this point the tow is in the position of the line designated A in FIG. 8. It should be noted that since the slots in yarn positioners 108 and 156 are aligned with the slots in cutter 141, the separate strands of yarn are enveloped by the slots in the cutter when the cutter is lowered into this position.

To attach the other tow into the machine, the same operations are performed, but this time the free end of yarn extends to the left as viewed in FIG. 1. After the yarn is secured in clips 177 and 178, lids 123 of yarn clamps 121 and 136 are lowered, deflecting clamps 134 and 135 which then snap back over lids 123, securing them in place. This second tow is in the position of the line B in FIG. 8, the separate strands thereof having fallen into the slots of cutter 142. The remaining part of the cycle is preferably automatically controlled and is initiated by the operator. The following occur in sequence:

1. Cylinders 129 raise clamping bars 124 thereby further securing the yarn within yarn clamps 121, 136.

2. Cylinder 139 draws yarn clamp 136 away from yarn spreader 105 into the position shown in FIG. 1 thereby stretching the yarn between yarn clamps 136 and 121.

3. Cylinder 145 raises splicing assembly 144. It should be noted that the individual splicing chambers 166 in splicing assembly 144 are aligned with the slots in yarn positioners 108, 161 and thus the individual strands of yarn are enveloped by the chambers 166 when splicing assembly 144 is raised into position.

4. Cylinders 170 close lid sections 168 thereby completely enclosing each strand of yarn in a splicing chamber.

5. Cylinder 139, operating under low pressure, returns yarn clamp 136 to the right as viewed in FIG. 1 until rollers 182 are contacted, the operating pressure being low enough to keep yarn clamp 136 in this position without excessive force on rollers 182. Slack is thus provided in the yarns to be spliced.

6. Cylinders 133 retract clamps 134, 135, thereby allowing tension in the yarns to force lids 123 upward into a position which will maintain clamps 134, 135 in their deflected position. Air is removed from cylinders 133 allowing clamps 134, 135 to spring back toward lid 123. Air to cylinders 129 is released so that clamping bars 124 are lowered, thereby releasing the yarn and providing slack yarn which may be drawn into the splicing chambers.

7. Through opening of valves 181, pressurized air is supplied to each splicing cavity 166 one at a time, thereby forming splices. This sequential rather than simultaneous actuation of the splicing chambers reduces the instantaneous air consumption of the apparatus.

8. Cylinders 151 actuate cutters 141 and 142, thereby trimming the terminal ends of the tow held in the slots of the cutters.

9. Cylinders 170 raise splicer lids 168, freeing the spliced sections of yarn; splicing assembly 144 is lowered by cylinder 145, rollers 182 rolling on inside yarn positioners 108 and 161.

10. Yarn clamp 130 is returned to its initial position by cylinder 139 operating at a higher air pressure for faster movement.

11. The operator raises lids 123 of yarn clamps 121, 136 and raises cutters 141, 142 manually removing waste ends from the apparatus.

12. The operator, depressing foot pedal 179, raises the spliced tow through guides 106.

The apparatus is now ready to repeat the splicing sequence.

What is claimed is:

1. In a tow splicing apparatus that includes a yarn clamping assembly for securing a plurality of pairs of abutting parallel yarn segments in spaced configuration, and an assembly for joining the filaments of one yarn segment of each pair with the filaments of the other yarn segment of that pair to form a joint, a device for dividing a tow into a plurality of substantially equal-sized segments comprising: a member attached to said yarn clamping assembly having a plurality of slots therein for reception of individual segments of yarn; a plurality of flexible guides, each guide being attached at one end to a location between said slots and extending in a vertical direction, said guides being pointed at their other ends; means for releasably pressing together the pointed ends of said guides; a retractable U-shaped anvil for supporting said tow to flatten it into a uniform warp positioned astride said pointed ends, said anvil being movable vertically from a position above said pointed ends to a position below said pointed ends as the tow is flattened on said anvil; and means for retracting said anvil from the vicinity of said pointed ends and releasing the pressure on said flexible guides as said tow is forced between said pointed ends in being flattened on said anvil into a uniform warp.

2. The apparatus of claim 1, including means for stretching then slackening the yarn within said clamping assembly.

* * * * *